US006561958B2

(12) United States Patent
Pappert

(10) Patent No.: US 6,561,958 B2
(45) Date of Patent: May 13, 2003

(54) WEIGHTED CUFF

(76) Inventor: Günther Pappert, A-5163, Mattsee 467 (AT)

( * ) Notice: Subject to any disclaimer, the term of this patent is extended or adjusted under 35 U.S.C. 154(b) by 150 days.

(21) Appl. No.: 09/764,189

(22) Filed: Jan. 17, 2001

(65) Prior Publication Data

US 2001/0024999 A1 Sep. 27, 2001

(30) Foreign Application Priority Data

Jan. 18, 2000 (AT) ..... GM 22/2000

(51) Int. Cl.[7] ..... A63B 21/065; A63B 23/10
(52) U.S. Cl. ..... 482/105; 482/79
(58) Field of Search ..... 482/79, 105, 44, 482/98, 106–109; 405/186–187; 63/8

(56) References Cited

U.S. PATENT DOCUMENTS 4,239,211 A * 12/1980 Wilkerson ..... 156/301
4,369,967 A * 1/1983 Kimura ..... 482/105
4,384,714 A 5/1983 Kimura
4,489,935 A 12/1984 Lusk
4,575,075 A 3/1986 Tarbox
4,602,784 A * 7/1986 Budden et al. ..... 482/105
4,621,808 A * 11/1986 Orchard et al. ..... 2/170
4,938,477 A 7/1990 Kuervers
5,683,335 A * 11/1997 Groves et al. ..... 482/105
6,361,511 B1 * 3/2002 Shim ..... 482/44

FOREIGN PATENT DOCUMENTS

JP 02107225 A * 4/1990 ..... A61B/05/022

* cited by examiner

*Primary Examiner*—Nicholas D. Lucchesi
*Assistant Examiner*—Fenn C Mathew
(74) *Attorney, Agent, or Firm*—Collard & Roe, P.C.

(57) ABSTRACT

A weighted cuff comprises a casing, a weight insert received in the casing, and a cylindrical spring clip embedded in the casing, the cylindrical spring clip imparting a desired shape to the casing and defining a slot extending along the length of the casing.

4 Claims, 1 Drawing Sheet

WEIGHTED CUFF

BACKGROUND OF THE INVENTION

1. Field of the Invention

The present invention relates to a weighted cuff comprising a casing and a weight insert received in the casing.

2. Description of the Prior Art

In the areas of fitness and health as well as in rehabilitation, not only dumbells and weights but also weighted cuffs are used for strenghtening the muscles. Usually, such weighted cuffs are comprised of elongated fabric or synthetic resin casings filled with sand, which may be wrapped around a wrist or ankle and are then secured by a Velcro fastener. Thus, the application of such weighted cuffs is quite cumbersome, and the applied weighted cuff tends to slip.

Various devices of this general type and useful for muscle-strengthening exercises or for measuring blood pressure have been disclosed, for example, in U.S. Pat. Nos. 4,384,714, 4,489,935, 4,575,075 and 4,938,477 as well as published PCT application No. WO 94/13207.

SUMMARY OF THE INVENTION

It is the primary object of this invention to provide a weighted cuff which may be handled in a simple manner and which firmly remains in place when applied.

The above and other objects of the invention are accomplished with a weighted cuff comprising a casing, a weight insert received in the casing, and a cylindrical spring clip embedded in the casing, the cylindrical spring clip imparting a desired shape to the casing and defining a slot extending along the length of the casing.

Such a weighted cuff may be easily handled and readily slipped over the desired extremities where it may then be adjusted without any problem. The resilient action of the spring clip embedded in the cuff casing assures a secure holding of the cuff on the extremity or joint to which it has been applied. The person exercizing with the weighted cuff may adjust its position at any time while exercizing so that the exercizing intensity may be readily adapted and changed without interrupting the exercize.

The weight insert may take various forms and may, for example, comprise metal powders, sand, synthetic resin (possibly of higher density), and the like. According to a preferred embodiment, however, the weight insert is comprised of metal plates carried by the cylindrical spring clip and optionally connected to each other. Because metal plates require little space, they are particularly useful as weights and permit the weighted cuffs to be held to relatively small dimensions. Furthermore, metal plates may be readily affixed to spring clips comprised of synthetic resin, spring steel or the like, particularly when they are interconnected.

According to another preferred embodiment, the cylindrical spring clip is foamed into the casing and may further comprise an inner cushioning layer. With a suitably selected soft synthetic resin as casing material, this produces a very comfortable weighted cuff. Such a weighted cuff may be readily cleaned because it is water-impermeable and washable.

BRIEF DESCRIPTION OF THE DRAWING

The above and other objects, advantages and features of the present invention will become more apparent from the following detailed description of a now preferred embodiment, taken in conjunction with the accompanying drawing wherein.

DETAILED DESCRIPTION OF PREFFERED EMBODIMENT

Figure 1:
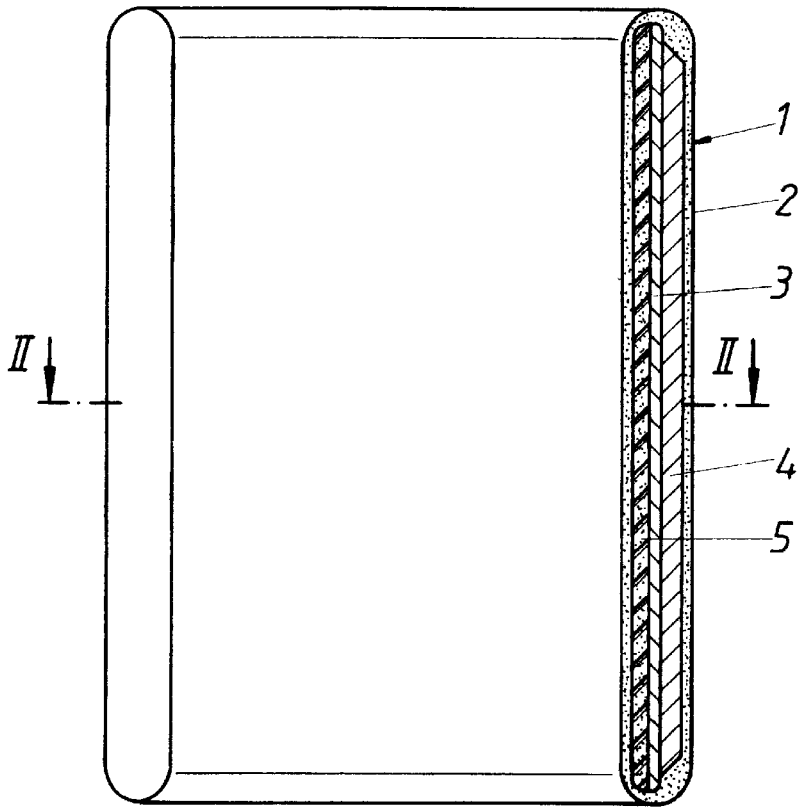
FIG. 1 shows a longitudinal section of a weighted cuff along line I—I of FIG. 2.
Figure 2:
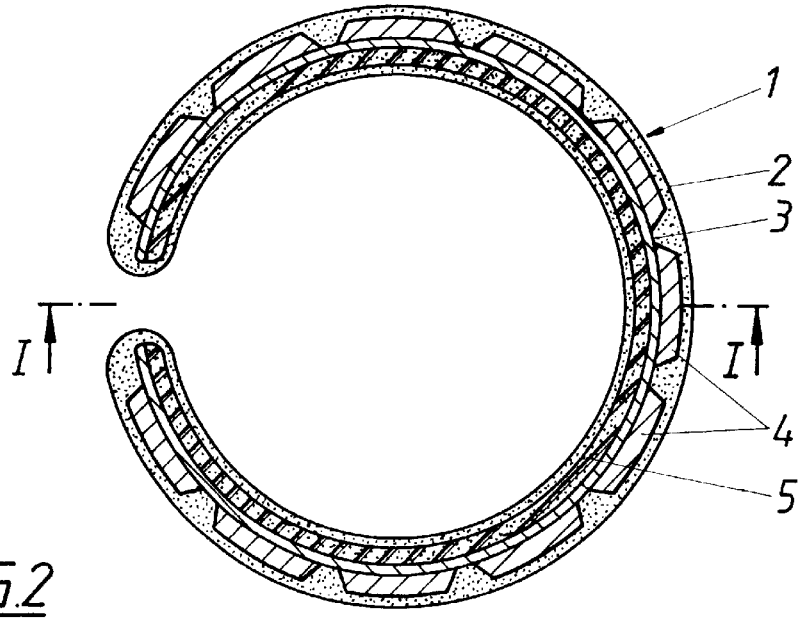
FIG. 2 shows a horizontal cross section along line II—II of FIG. 1.

As shown in the drawing, weighted cuff 1 comprises casing 2, a weight insert received in casing 2, and cylindrical spring clip 3 embedded in the casing. The cylindrical spring clip imparts a desired shape to casing 2, for example for application to an arm, and defines a slot extending along the length of the casing. The weight insert of illustrated weighted cuff 1 is comprised of metal plates 4 carried by cylindrical spring clip 3. The metal plates are affixed to the outside of the spring clip and may be connected to each other. In the illustrated embodiment, cylindrical spring clip 3 is foamed into foamed synthetic resin casing 2, together with an inner cushioning layer 5 and metal plates 4 affixed to the spring clip.

What is claimed is:

1. A weighted cuff comprising a casing, a weight insert received in the casing, and a cylindrical spring clip embedded in the casing, the cylindrical spring clip imparting a desired shape to the casing and defining a slot extending along the length of the casing, wherein the weight insert is comprised of metal plates carried by the cylindrical spring clip.

2. The weighted cuff of claim 1, wherein the metal plates are connected to each other.

3. The weighted cuff of claim 1, wherein the cylindrical spring clip is foamed into the casing.

4. The weighted cuff of claim 3, wherein the cylindrical spring clip further comprises an inner cushioning layer.

* * * * *